US009924584B2

(12) United States Patent
Smith

(10) Patent No.: US 9,924,584 B2
(45) Date of Patent: Mar. 20, 2018

(54) METHOD AND DEVICE CAPABLE OF UNIQUE PATTERN CONTROL OF PIXEL LEDS VIA SMALLER NUMBER OF DMX CONTROL CHANNELS

(71) Applicant: James David Smith, Raleigh, NC (US)

(72) Inventor: James David Smith, Raleigh, NC (US)

( * ) Notice: Subject to any disclaimer, the term of this patent is extended or adjusted under 35 U.S.C. 154(b) by 0 days.

(21) Appl. No.: 15/090,042

(22) Filed: Apr. 4, 2016

(65) Prior Publication Data

US 2016/0234912 A1 Aug. 11, 2016

Related U.S. Application Data

(63) Continuation-in-part of application No. 14/680,014, filed on Apr. 6, 2015, now abandoned, which is a continuation-in-part of application No. 14/066,303, filed on Oct. 29, 2013, now Pat. No. 9,226,375, application No. 15/090,042, filed on Apr. 4, 2016, which is a continuation-in-part of application No. 14/134,453, filed on Dec. 19, 2013, and a (Continued)

(51) Int. Cl.
*H05B 37/02* (2006.01)

(52) U.S. Cl.
CPC ..... *H05B 37/029* (2013.01); *H05B 37/0272* (2013.01)

(58) Field of Classification Search
CPC .. G05B 15/02; H05B 37/0272; H05B 37/029; H05B 33/0845
See application file for complete search history.

(56) References Cited

U.S. PATENT DOCUMENTS 5,603,012 A * 2/1997 Sotheran ..... G06F 9/3867 370/450
6,166,496 A * 12/2000 Lys ..... H05B 33/0857 315/292

(Continued)

FOREIGN PATENT DOCUMENTS

CN 101207956 A 6/2008
DE 102005043184 A1 3/2007

(Continued)

OTHER PUBLICATIONS

Lutron; "DMX-512 Fundamentals"; Jul. 29, 2010.

*Primary Examiner* — Alexander H Taningco
*Assistant Examiner* — Kurtis R Bahr
(74) *Attorney, Agent, or Firm* — Italia IP; James A. Italia

(57) ABSTRACT

A method of pixel control which reduces the number of DMX control channels required for generation of artistic pixel patterns displayed on a large number of pixel LEDs is described. Further described are a set of control parameters which facilitate the introduction of pixel control and sophisticated pixel pattern generation without a costly DMX controller upgrade. Also described is a device for generating lighting effects. The device may be portable, battery-powered, radio-controlled and small enough to easily hide in most theatrical and film sets, set pieces, props, and practicals. The device may be configured to process DMX data for controlling and generating graphical patterns among pixel LEDs based on the set of one or more control parameters. The method and device relocate the processing of the DMX data from the DMX controller to one or more individual hardware drivers for the pixel LEDS.

18 Claims, 7 Drawing Sheets

Related U.S. Application Data continuation-in-part of application No. 14/134,515, filed on Dec. 19, 2013.

(56) References Cited

U.S. PATENT DOCUMENTS 6,175,201 B1 * 1/2001 Sid ..... H05B 37/0254 315/292
6,545,586 B1 * 4/2003 Belliveau ..... H04L 12/403 315/314
7,139,617 B1 * 11/2006 Morgan ..... H05B 37/029 345/207
7,553,039 B2 6/2009 Harris et al.
7,573,491 B2 * 8/2009 Hartkop ..... G02B 27/2214 345/419
8,742,686 B2 * 6/2014 Zampini, II ..... H05B 33/0857 257/13
9,011,247 B2 * 4/2015 Gronkowski ..... G07F 17/3211 463/30
2004/0105261 A1 * 6/2004 Ducharme ..... H05B 33/0857 362/231
2004/0160199 A1 * 8/2004 Morgan ..... A01M 1/04 315/312
2004/0252486 A1 * 12/2004 Krause ..... A63J 17/00 362/85
2005/0286646 A1 * 12/2005 Fails ..... G08C 17/02 375/259
2006/0001387 A1 1/2006 Chansky et al.
2006/0082331 A1 * 4/2006 Ashdown ..... H05B 33/0842 315/291
2008/0082214 A1 * 4/2008 Haskell ..... G06T 13/40 700/264
2008/0191642 A1 * 8/2008 Slot ..... H05B 33/0818 315/295
2009/0190346 A1 * 7/2009 Belliveau ..... H05B 37/029 362/231
2011/0115413 A1 * 5/2011 Erickson ..... H05B 37/029 315/312
2013/0169192 A1 * 7/2013 Goldsmith ..... H05B 37/02 315/312
2013/0278169 A1 * 10/2013 Reinoso ..... H05B 37/0272 315/294
2015/0137958 A1 * 5/2015 Norlen ..... G08C 17/02 340/12.5

FOREIGN PATENT DOCUMENTS

WO 2009114636 A2 9/2009
WO 2010088883 A2 8/2010

* cited by examiner

METHOD AND DEVICE CAPABLE OF UNIQUE PATTERN CONTROL OF PIXEL LEDS VIA SMALLER NUMBER OF DMX CONTROL CHANNELS

CROSS-REFERENCE TO RELATED APPLICATIONS

This application is a Continuation-in-Part to, and claims the benefit of priority to, U.S. Non-Provisional application Ser. No. 14/680,014, which was filed on Apr. 6, 2015, which in turn is a Continuation-in-Part to, and claims the benefits of priority to, U.S. Non-Provisional application Ser. No. 14/066,303, filed on Oct. 29, 2013, now U.S. Pat. No. 9,226,375;

This application is a Continuation-in-Part to, and claims the benefit of priority to, U.S. Non-Provisional application Ser. No. 14/134,453, filed on Dec. 19, 2013.

This application is a Continuation-in-Part to, and claims the benefit of priority to, U.S. Non-Provisional application Ser. No. 14/134,515, filed on Dec. 19, 2013.

Each of the foregoing patent applications, patent publications, and patents is hereby incorporated by reference in its entirety.

BACKGROUND OF THE INVENTION

Field of the Invention

This disclosure relates generally to devices for controlling theatrical effects, and more specifically to portable radio-controlled devices using the Digital MultipleX (DMX) protocol for controlling theatrical effects, including lighting effects, in theatrical and film sets, set pieces, props, practicals, and other entertainment and educational applications. In particular, the present disclosure relates to a device and method that allocates processing of LED pixel patterns from a DMX controller out to physical pixel drivers using a parametric approach.

Description of Related Art

Professional entertainment, including but not limited to theatre, film, television, sports events, and news broadcasts, make frequent use of LED pixel strings based on various control chips and LEDs with integrated chips for individual addressing, including but not limited to:

WORLDSEMI WS2801 R/G/B driver integrated circuit for use with external LEDs

WORLDSEMI WS2812 R/G/B LED with built-in driver components

LPD6803/LPD8803 (manufacturer unknown) R/G/B driver integrated circuit

SHIJI LIGHTING APA102 R/G/B LED with built-in driver components

HL1606 (manufacturer unknown) R/G/B driver integrated circuit

Each of these products uses a unique high-speed serial data protocol most often based on 5V asynchronous 4-wire SPI (5-volt Serial Peripheral Interface consisting of data, clock, power, and ground connections). Some, most notably the WORLDSEMI WS2812 and compatible products, use a 3-wire synchronous interface (only data, power, and ground connections).

Since these communication methods and protocols are not standardized between products, and not directly addressable via standard entertainment lighting control methods, numerous data conversion devices already exist.

In at least one case, a pixel string control chip is available that responds directly to entertainment industry standard DMX control data. This eliminates the need for protocol conversion but still presents other addressing problems noted and accommodated by the methods disclosed here.

There are two common approaches to controlling pixel LEDs in professional entertainment applications:

1) Graphics processors convert video content to pixel-string data for real-time video-wall display. This could be considered the "raster" or "bitmap" method of control, which is ideal for photo-realism.

2) DMX lighting control consoles, typically with pixel programming features for building visually appealing patterns, control pixels in the same manner that color-changing lighting fixtures and moving lights are controlled. This could be considered the "vector" method, and is not used for photo-realism. Although the content is necessarily transferred to a bitmap format for final presentation, authoring of content tends to be more vector-like.

One DMX universe consists of a maximum of 512 8-bit control channels. Controlling more channels requires multiple universes. DMX channels are typically mapped to LED pixels in a 1-to-1 fashion, with each pixel requiring 3 (or more) DMX channels. For typical red/green/blue pixel LEDs, three channels are required for each. Some pixel strings use four channels, adding white. (Other configurations are also possible; for example, a 5-color string might add amber for a red/amber/green/blue/white pixel.)

Red/green/blue pixel strings are most common. Since a standard DMX universe accommodates 512 data channels, and each pixel requires three of them, one DMX universe supports just 170 pixels, which leaves 2 DMX channels unused since a 513th channel would be needed to complete what would be the 171st 3-color pixel. When applied to a matrix, 170 pixels could, for example, be displayed as a rectangle of 10×17 pixels. This DMX control structure yields very little display area and consumes massive system resources, considering that one DMX universe was originally intended to control all the lighting fixtures in a large and complex entertainment project.

Large and complex pattern displays may utilize thousands of pixels. For control via DMX, many simultaneous 512-channel universes must be running in parallel and be perfectly synchronized. Only the largest and most costly DMX consoles are capable of this, including the High End Systems Hog 4, and MA Lighting Grand MA. These consoles also provide pixel-pattern generation tools with flexibility to choose how many pixels will be used, assign them to multiple dimensions (i.e. one dimension would be one long string, two dimensions would define a rectangle of rows and columns, etc.), and then create changes of color and brightness that animate across the field.

For a simple pattern displayed on four 170-pixel red/green/blue pixel strings, 4 full DMX universes of data are required, totaling 2048 DMX channels, and this still yields a rectangular field that is only 26×26 pixels.

The pixel strings themselves are small, lightweight and low cost. The required controllers, however, are costly and bulky. In almost all cases, the most desirable and visually pleasing LED pixel patterns—the ones requested most often of professional lighting designers—incorporate symmetry, parallelism, mirroring, and simple repetition. That said, there is no limit to the creativity an individual artist may apply to authoring unique patterns. Preprogrammed or "canned" patterns are not of interest to the world's leading lighting designers.

Examples of Vector Pattern Control Using Existing Methods

Two very common pixel pattern effects that are commonly requested of lighting designers are presented here as examples:

Simple Marquee

A series of lamps around the entrance of a motion picture theatre is an eye-catching, now iconic, visual attraction. Replicating this effect in theatre, film, and television sets using pixel LEDs is a common task.

Using typical DMX control and addressing methods, every pixel is a 3-color (red/green/blue) device that is individually controlled from a DMX lighting console. Thus, a marquee with 20 vertical lamps on the left, 40 horizontal lamps across the top, and 20 vertical lamps on the right, presents a total of 80 lamps and consumes 240 DMX control channels.

An authentic look for such a marquee is created by grouping pixels in sets of three. We will refer to these as pattern pixels a, b, and c. DMX channels 1, 2, and 3 are assigned to the first a pattern pixel. Channels 4, 5, and 6 are assigned to the first b pattern pixel. Channels 7, 8, and 9 are assigned to the first c pattern pixel. From here on, the pattern is repeated. DMX channels 10, 11, and 12 are assigned to the second a pixel. Channels 13, 14, and 15 are assigned to the second b pixel. Channels 16, 17, and 18 are assigned to second c pixel. This continues all the way to the end of the series of lamps, consuming a total of 240 channels.

Pixel pattern features in the controlling console are then used to group channels into the a, b, and c groups. Although the visual effect requires manipulation of only those three elements—brightness of a, b, and c—almost half of an entire DMX universe is consumed to generate and transfer this data out to the pixel strings.

Symmetrical Patterns Around a Procenium, Sports Desk, or Other Frame

It has become popular to place strings of pixels up and around a proscenium, or across the front of a sports broadcast desk (a television prop), or around any other visual frame (or to create the impression of such a frame) in an entertainment presentation.

Most often these pixels are used to display patterns that "wipe," "chase," or "mirror" up, down, and around the area. In the case of a large proscenium, a string of 500 pixels down each side, meeting at the top center, creates an attractive framework for these patterns.

Those 1000 pixels consume 3000 DMX control channels, requiring 6 DMX universes of control data. This can be accomplished only with the most sophisticated and costly DMX controllers, which also consume considerable space and electrical power, and require a highly skilled operator.

Using pixel pattern generation features in those controllers, an attractive look will often be defined on just half the display, then mirrored to the other side. Creation of the effect requires 1500 DMX channels, but realizing the look across the physical proscenium, with mirroring on the opposite side, demands 3000 channels of raw control data.

Various entertainment control devices for pixel strings do exist, all of which are limited to simple 1-to-1 mapping of control data to physical pixels. They generally use DMX over Ethernet protocols, like ACN or ArtNet, providing many simultaneous universes of data simultaneously. Further, various DMX controllers with features for pattern generation already exist. However, in every case they are implemented at the front of the design process and require large numbers of individual control channels to distribute pattern data out to hardware pixel drivers. There is a need in the art for a device and method which (i) allows far fewer channels to be distributed, (ii) achieves identical or nearly identical pattern appearance, and (iii) leaves the designer and programmer with direct creative control of how the patterns are produced.

SUMMARY OF THE INVENTION

Embodiments of the present invention provide a method of pixel control which reduces the number of DMX control channels required for generation of artistic pixel patterns displayed on a large number of pixel LEDs. Many theatre, film, television, and educational facilities are equipped with a DMX controller that generates only one or two universes of DMX data, and many of those DMX channels are already in use to control existing lighting fixtures in the facility. Embodiments of the invention provide a set of control parameters (also referred to herein as "Custom Pixel Profiles") which facilitate the introduction of pixel control and sophisticated pixel pattern generation without a costly DMX controller upgrade. Alternatively, in new installations, pixel control and sophisticated pixel patterns can be generated without the expense of a top-of-the-line DMX controller.

Embodiments of the present invention further provide a device for generating lighting effects. Embodiments of the device may be portable, battery-powered, radio-controlled and small enough to easily hide in most theatrical and film sets, set pieces, props, and practicals. Several such wireless controller devices may be controlled by a single wireless controller. In embodiments, the device may be configured to process DMX data for controlling and generating graphical patterns among pixel LEDs based on a set of one or more control parameters such as Custom Pixel Profiles. In embodiments, the one or more control parameters reduce a number of DMX control channels required to generate graphical patterns among the pixel LEDs. In embodiments, the device receives DMX channel data from a wireless DMX transmitter and converts the DMX channel data to one or more outputs, wherein each output is capable of controlling an LED pixel string. Embodiments of the device may further provide for capture of preferred control parameters with a single button, as well as single-button capture of ColorMatch (i.e. white balance adjustment) ratios. Embodiments of the device further provide the ability to apply ColorMatch in all modes, not just Hue, Saturation and Luminance (HSL) mode.

Additional embodiments of the invention provide a device capable of receiving DMX data from a DMX lighting controller. The DMX data specifies primary color settings of pixel LEDs. The device is further capable of capturing the primary color settings with a single button push. In some embodiments, the device receives the DMX data from the DMX lighting controller in a wireless format. In some embodiments, the device is battery powered.

BRIEF DESCRIPTION OF THE DRAWINGS

The accompanying drawings illustrate certain aspects of embodiments of the present invention, and should not be used to limit the invention. Together with the written description the drawings serve to explain certain principles of the invention.

DETAILED DESCRIPTION OF VARIOUS EMBODIMENTS OF THE INVENTION

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

The following detailed description includes references to the accompanying drawings, which form a part of the detailed description. The drawings show illustrations in accordance with example embodiments.

Embodiments of the invention provide systems, devices, and methods for reducing the number of DMX control channels required for creating patterned displays with large number of pixel LEDS. More particularly, the present invention in embodiments is a system, device and method that allow a user to control patterns in LED displays using a parametric approach. As a result, pattern control is moved out from the master data controller out to the physical hardware drivers of the LEDs. This allows far fewer channels to be distributed, achieves identical or nearly identical pattern appearance, and leaves the designer and programmer with direct creative control of how the patterns are produced.

The systems, devices and methods described herein allow for controlling theatrical effects engines and devices. The technology for controlling described in the current disclosure may be practiced in theatrical and film sets, set pieces, props, practicals, and other entertainment and educational applications. In particular, the systems, devices, and methods described herein allow for controlling patterns in pixel LED displays.

In some embodiments, the system for controlling theatrical effects may comprise a main console device and a set of battery-powered wireless controller devices. In some embodiments the controller device may comprise a receiver, a protocol converter and set of hardware ports and outputs. The receiver can be configured to receive data, convert the received data to DMX data, and provide the DMX data to a protocol converter. The protocol converter may be configured to either emulate a memory peripheral to be read via hardware ports or provide data to outputs in different formats. In other embodiments, the controller device may comprise a microcontroller and integrated H-bridge power dimmer. The H-bridge power dimmer may be configured to operate as an AC inverter or a bidirectional DC motor driver.

Figure 1:
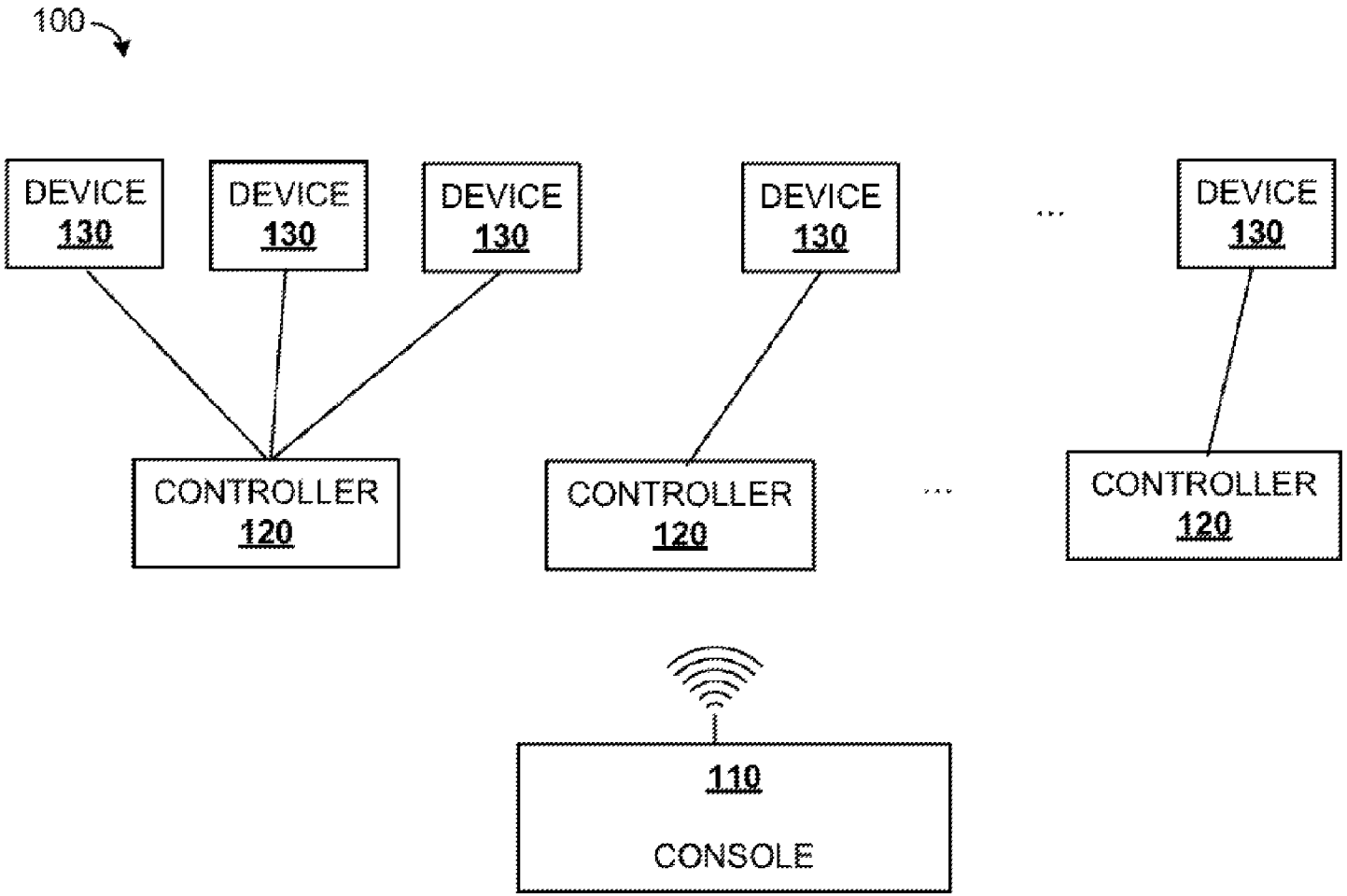
FIG. 1 is a schematic diagram showing a system for controlling theatrical effects according to an embodiment of the invention.

FIG. 1 shows a system 100 for controlling theatrical effects according to an example embodiment. The system 100 may comprise a console unit 110 and one or more battery-powered radio-controlled devices 120. The controller devices 120 may be placed on a theatrical or film stage, or another entertainment set, and controlled by the console unit 110 via a radio signal. Each of the controller devices, may, in turn, govern one or more theatrical effect devices 130. The theatrical effect devices 130 may include one or more LED pixel lighting products.

In some embodiments the console unit 110 may transmit Digital MultipleX (DMX) data directly to controller devices 120. In other embodiments the console unit 110 may convert the DMX data into a wireless format and transmit the data to controller devices 120 by a radio signal. The format may use System IDs for privacy and may include error checking and other defenses against dropouts and interference.

Figure 2:
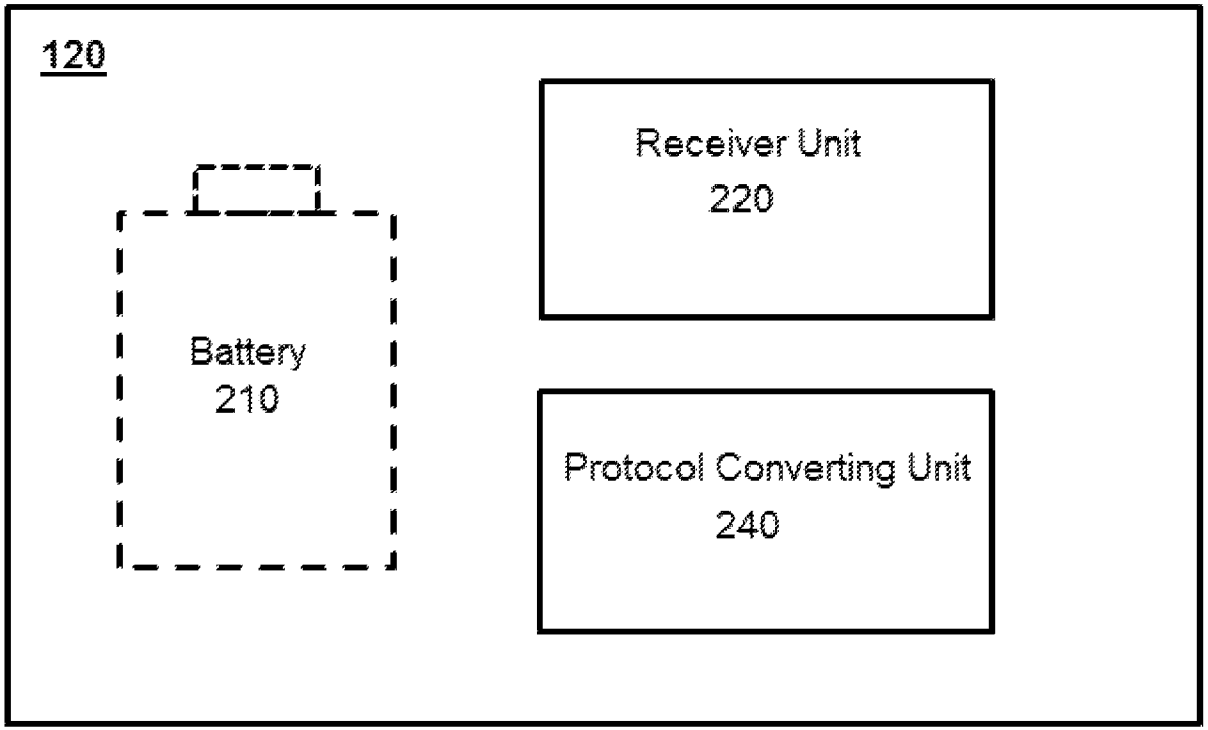
FIG. 2 is a schematic diagram depicting a battery-powered radio-controlled device for controlling theatrical effects according to an embodiment of the invention.

FIG. 2 depicts a battery-powered radio-controlled device 120 for controlling theatrical effects according to an example embodiment. The controller device 120 may include at least a battery 210, a receiver unit 220, a protocol converter unit 240, and one or more hardware ports and outputs. Each of the hardware ports and outputs may comprise one of the following:

an Inter-Integrated Circuit (I2C) port;

a Serial Peripheral Interface (SPI) port;

an Open-Collector output;

an 0-10V Control-Voltage output;

a Pulse Modulation output;

a Musical Instrument Digital Interface (MIDI) data output; and a DMX data output.

Multiple devices 130 connected to hardware ports and outputs can be controlled simultaneously, responding to data from the same wireless DMX console 110. By configuring data ports on each device to respond to different DMX channels, a range of different props and effects can all be controlled from one main DMX console 110 that runs the entire show.

In some embodiments of controller devices 120, the I2C port and the SPI port may share the same data connection points, while in other embodiments the I2C port and the SPI port may have different connection points, so the ports may be used independently and simultaneously.

Similarly, in some embodiments, the MIDI data output and the DMX data output can share data connection points, while in other embodiments the MIDI data output and DMX data output may have different connection points, so that the ports may be used independently and simultaneously.

The receiver 220 may receive data in a wireless format transmitted by the controller 110 of FIG. 1, convert the data to the industry-standard DMX format and pass the converted data to protocol converter 240. In certain embodiments the receiver 220 may receive data in a wireless format and pass the received data to protocol converter 240 without converting the received data to DMX format.

In the embodiments of device 120, comprising at least one of the I2C ports or the SPI ports, the protocol converter 240 may be configured to emulate a memory peripheral with 512 memory addresses representing the 512 channels of DMX universe. As used herein, the term "memory" may refer to any non-transitory computer readable medium configured for storage, such as floppy disks, conventional hard disks, CD-ROMS, Flash ROMS, non-volatile ROM, electrically erasable programmable read-only memory (EEPROM), and RAM. One or more external microprocessor-based devices having an I2C or an SPI communication bus may have access to the emulated memory peripheral via the I2C or SPI interface ports of device 120 to query any DMX channel provided to protocol converter in real time. The external devices may dispose one of the Arduino, Raspberry Pi, PicAxe, Basic Stamp and other microprocessors, microcontroller, and system-on-chip devices.

In the embodiments of device 120 comprising one or more open collector outputs, the protocol converter may be configured to assign a DMX channel to any of available open collectors. Normal or inverted polarity of the open collector may be selected by a user using console 110. A DMX level may be set as a turn-on threshold for the open collector.

In some embodiments, the open collector may be configured as Pulse-Width-Modulation dimmer to dim small lamp or light-emitting diode (LED) or to control the speed of small DC motor.

In the embodiments of device 120 comprising one or more 0-10V Control-Voltage (CV) outputs, the protocol converter 240 may be configured to assign a DMX channel to any available CV outputs by a user via console 110. The protocol converter 240 may be configured to scale, shift, and invert the DMX data, and to assign linear or inverse-square-law output curves.

In the embodiments of device 120 comprising one or more Pulse Modulation (PM) outputs, the protocol converter 240 may be configured to assign a DMX channel to any available PM outputs by a user via console 110. The protocol converter 240 may be configured to scale, shift, and invert the DMX data to control the direction and range of motion of connected device, i.e. a servo motor.

In the embodiments of device 120 comprising one or more MIDI data outputs, the protocol converter 240 may be configured to convert 16 DMX channels to a MIDI note messages. The starting DMX channel, MIDI channel, and MIDI starting note number may be selected by a user using console 110. Modes for using MIDI note velocity and MIDI polyphonic after touch for DMX channel levels may be also selected by a user using console 110.

In another embodiment, any number of DMX channels could be processed, and DMX data could be mapped to any desired MIDI channel and parameter. In yet another embodiment, the user could build specific MIDI messages to be sent when particular DMX data events occur.

Figure 3:
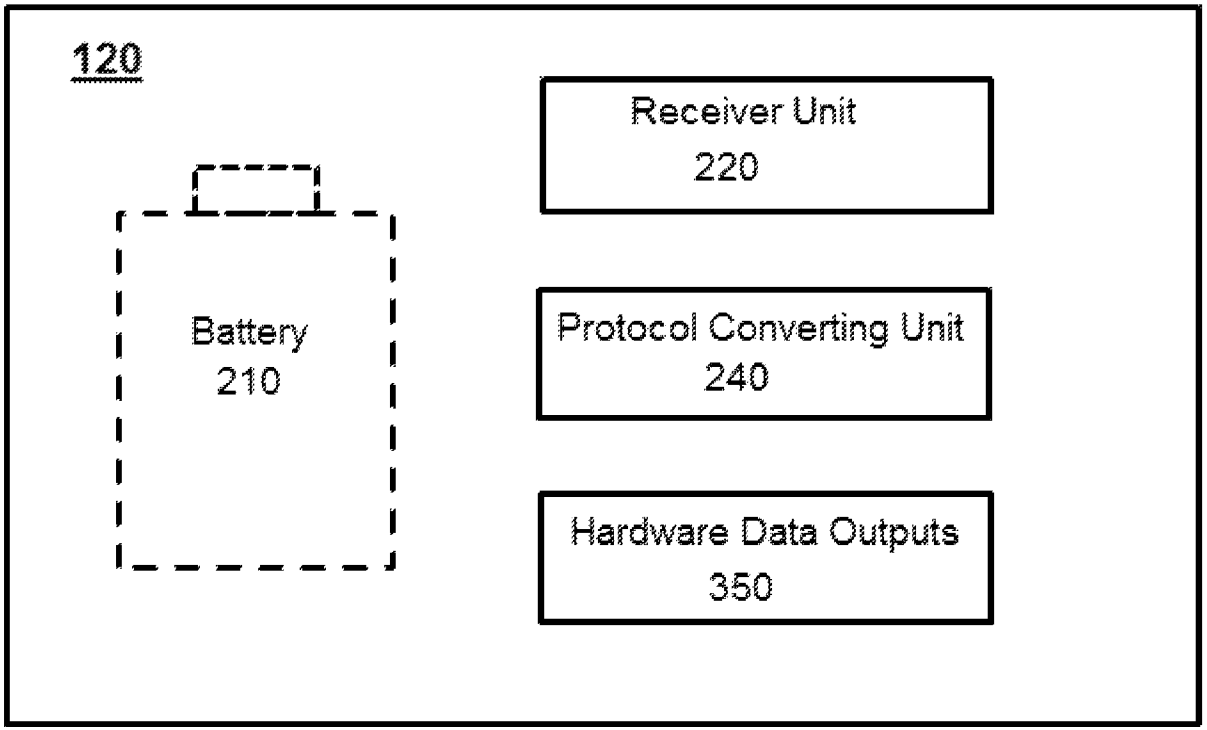
FIG. 3 is a schematic diagram depicting a battery-powered radio-controlled device for controlling theatrical effects according to another embodiment of the invention.

FIG. 3 depicts a battery-powered radio-controlled device 120 for controlling theatrical effects according to another example embodiment. The controller device 120 may include at least a battery 210, a receiver unit 220, a protocol converter unit 240, and one or more hardware data outputs (HWDO) 350.

The format of data outputted by the HWDO may be selected using one or more DMX channels. The selectable formats include but not limited to: DMX, DIMI, Pulse Code/PWM, Open Collector, SPI, and I2C.

Some embodiments of the controller device 120 may include both format selectable hardware data outputs and output ports configured to output data in only one pre-fixed format. In certain embodiments, certain DMX channels received by the controller device 120 may be reserved for fixed data format. For example, in some embodiments DMX channel 194 and DMX channel 250 can be reserved for the PWM data format. Some of data formats can be specified using more than one DMX channels. For example in case of the MIDI format, several DMX channels can be used to specify how DMX data will be converted to a specific MIDI protocol.

Figure 4:
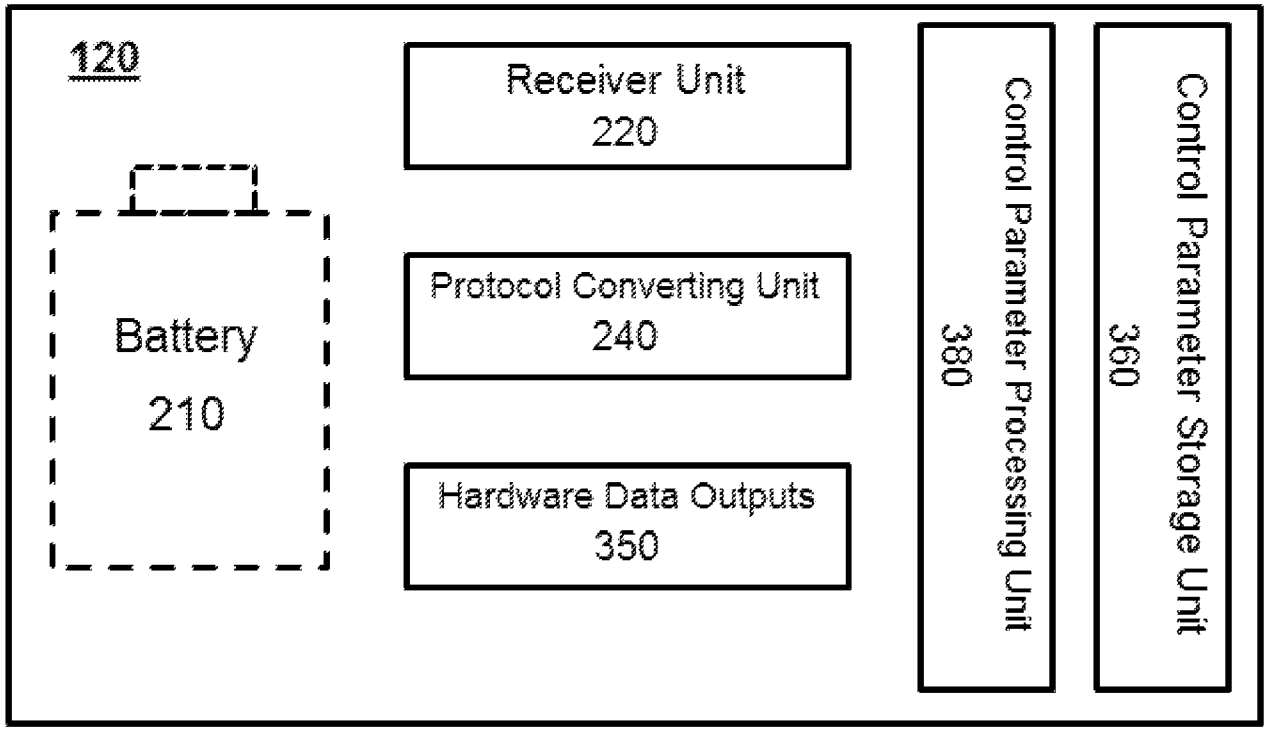
FIG. 4 is a schematic diagram depicting a battery-powered radio-controlled device for controlling theatrical effects according to yet another embodiment of the invention.

FIG. 4 depicts a battery-powered radio-controlled device 120 for controlling theatrical effects according to another embodiment. The controller device 120 may include at least a battery 210, a receiver unit 220, a protocol converter unit 240, one or more hardware data outputs (HWDO) 350, a control parameter storage unit 360 or memory, and a control parameter processing unit 380. The control parameter storage unit 360 may store Custom Pixel Profile parameters according to the input of a user, while the control parameter processing unit 380 may process DMX data according to the settings of the Custom Pixel Profile parameters. As described further herein, the Custom Pixel Profile parameters provide for the control of patterns in a plurality of pixel LEDS, while reducing the number of channels required to achieve such patterns compared to devices and methods which do not rely on such parameters (i.e. rely on 1 to 1 mapping of DMX channels to pixels). Thus, the Custom Pixel Profile parameters provide for greater than 1 to 1 mapping of DMX channels to pixels such that a large numbers of pixels can be controlled with only a few DMX channels. In embodiments, the Custom Pixel Profiles define one or more aspects of pattern generation among the pixel LEDs and allow for processing of DMX data to occur at a point of processing external to the DMX controller.

The control parameter storage unit 360 may be configured to store user-specified settings of the Custom Pixel Profiles shown in FIG. 6, which will be elaborated further below. The control parameters processing unit 380 may assign specific DMX control channels to each parameter and match settings of each parameters to levels of the DMX control channels. In this way, the device 120 allows a user to configure Custom Pixel Profile settings with DMX control channels.

Figure 5:
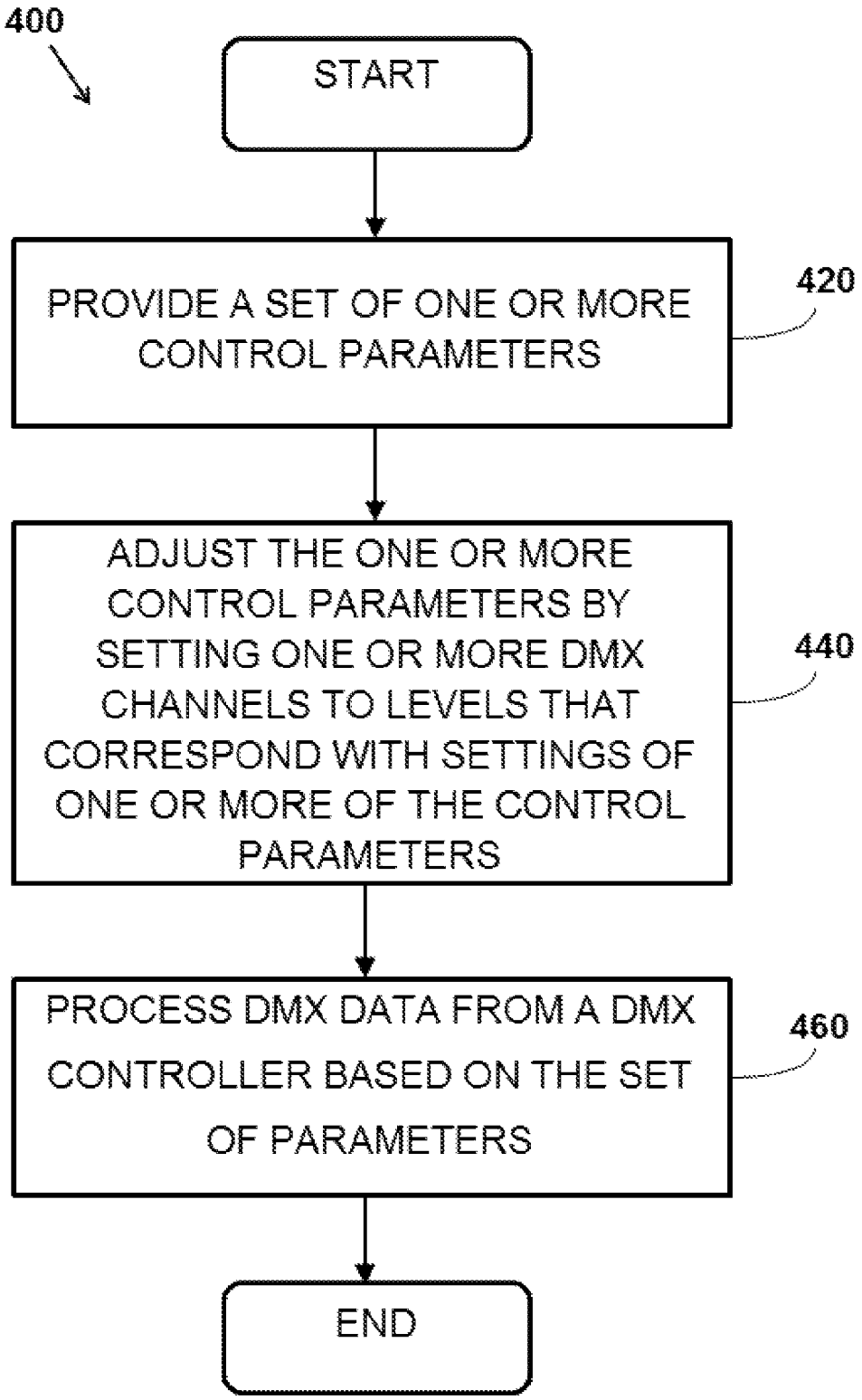
FIG. 5 is a flowchart showing a method according to an embodiment of the invention.

An embodiment of a method of the present invention is shown in FIG. 5. This embodiment provides a method 400 of processing DMX data for controlling and generating graphical patterns among pixel LEDs. The method includes providing a set of one or more control parameters 420, adjusting the one or more control parameters by setting one or more DMX channels to levels that corresponding with settings of one or more of the control parameters, 440, and processing DMX data from a DMX controller based on the set of parameters 460. In this embodiment, the one or more control parameters reduce a number of DMX control channels required to generate graphical patterns among the pixel LEDs. Further, in embodiments, the processing occurs at a point of processing external to the DMX controller. The one or more control parameters define one or more aspects of pattern generation among the pixel LEDs.

Thus, some embodiments of the invention provide a collection of user-configurable parameters, or Custom Pixel Profiles, that may be used by a lighting designer or programmer. The user-configurable parameters define how incoming DMX data will be interpreted, processed, and sent down the serial data line to pixel LEDs to generate patterns among the pixel LEDs. In a preferred embodiment, this processing is performed in the hardware pixel driver itself. In other embodiments, this processing is performed in a small preprocessor between the DMX controller and the pixel drivers.

Figure 6:
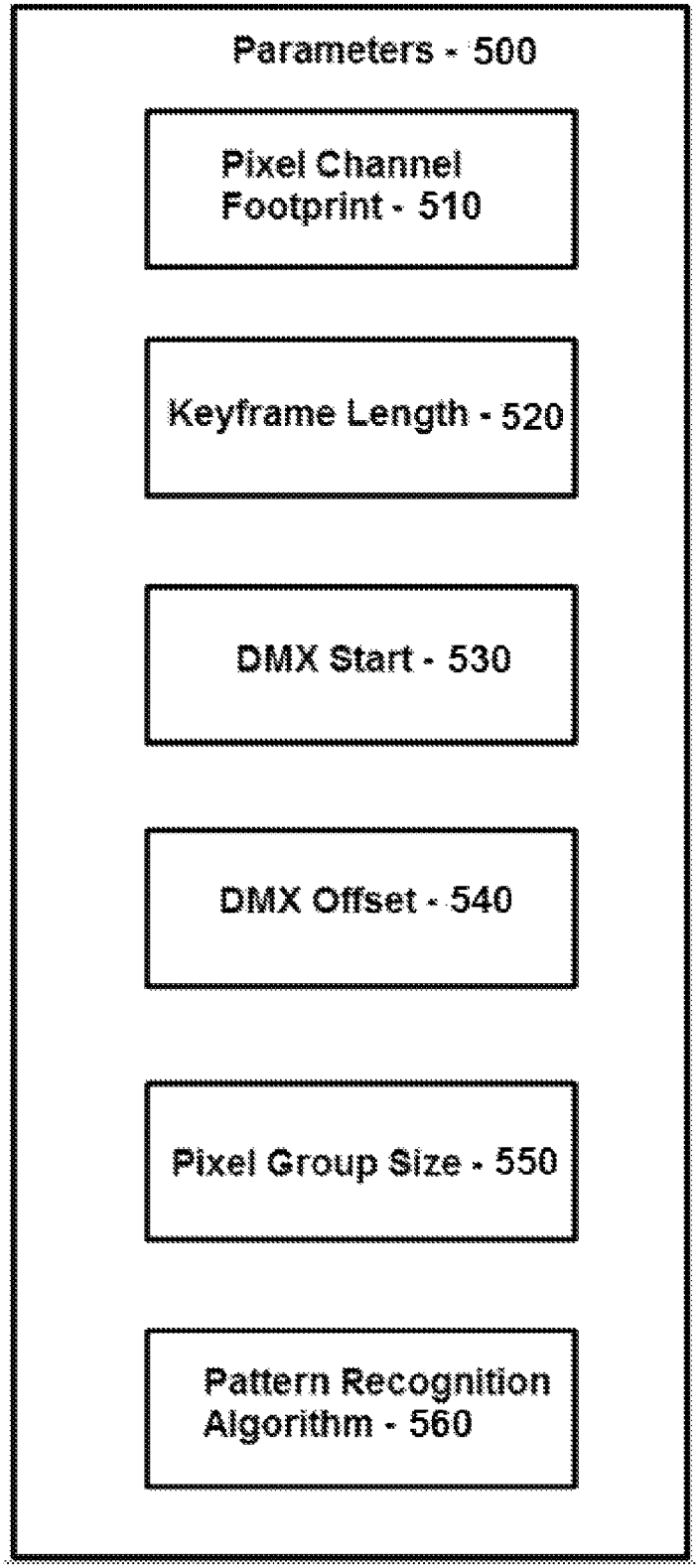
FIG. 6 is a schematic diagram showing a set of control parameters, or Custom Pixel Profiles, according to an embodiment of the invention.

The following, shown in FIG. 6, describe examples of control parameters 500 that can be used in the device and method of the invention:

Pixel Channel Footprint 510 is the number of individual DMX control channels that comprise a single LED pixel. This is most commonly 3 channels for red/green/blue.

Keyframe Length 520 is the number of pixels that comprise a source, seed, or "keyframe" pattern generated by the external DMX controller or other authoring tool preferred by the lighting designer. For example, if the keyframe consists of 60 red/green/blue pixels, the keyframe will use 60×3=180 DMX channels. The lighting designer then generates keyframe data of this size with a standard DMX controller.

The DMX Start 530 is the channel number within a 512-channel DMX universe where keyframe data begins. This allows multiple keyframes to be defined within a single DMX universe, and allows seamless integration of pixel control into DMX universes that are also controlling conventional lighting instruments.

The DMX Offset 540 denotes the channel within the keyframe where the driver will begin pattern generation for its first physical pixel. Multiple hardware pixel drivers may run side-by-side using the same keyframe data but different offset points.

The Pixel Group Size 550 allows multiple physical pixels to be mapped to each control pixel. This extends the length of an LED pixel string that may be controlled with a given number of DMX channels. For example, with a 1-to-1 mapping and a group size of 3, one DMX universe of data will control 510 pixels. Multiple hardware pixel drivers can use different group size values while using the same keyframe data.

Figure 7:
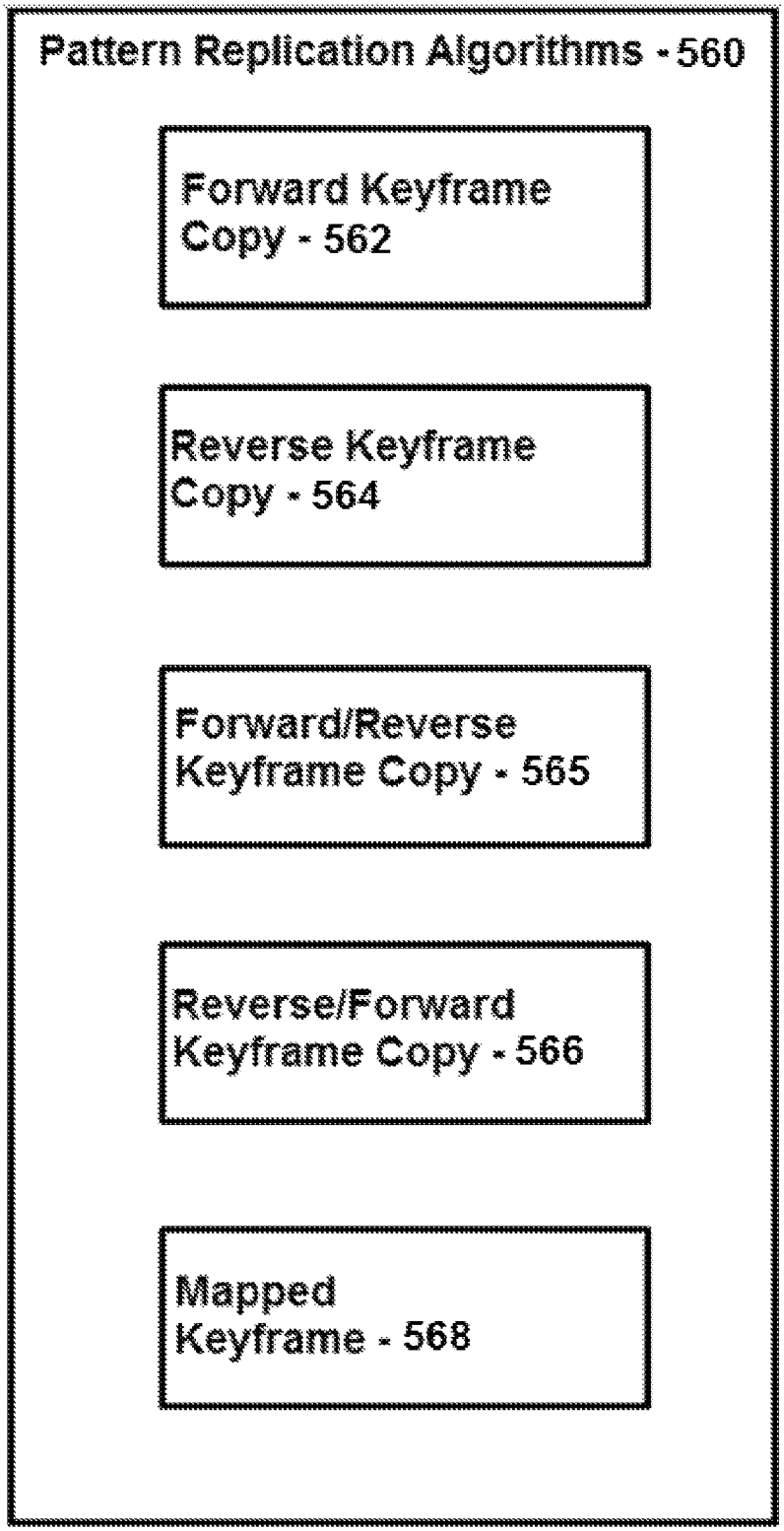
FIG. 7 is a schematic diagram showing a set of pattern replication algorithms according to an embodiment of the invention.

The Pattern Replication Algorithm 560 defines how pixel data will be distributed across a pixel string of any length. Multiple drivers using the same keyframe data may use different replication algorithms, shown in FIG. 7, including:

Forward Keyframe Copy 562 displays the keyframe data as presented by the external DMX controller, and then repeats the keyframe consistently for subsequent blocks of pixels. For example, if the Keyframe Length is 60, then pixel 61 will be identical to pixel 1, pixel 62 will be identical to pixel 2, and so on to pixel 119 which will be identical to pixel 59. The pattern will then repeat again, with pixel 120 being identical to pixel 1. This repetition continues for the maximum number of pixels supported by the hardware driver electronics.

Reverse Keyframe Copy 564 displays the keyframe data as presented by the external DMX controller, but mapped to pixels in reverse order. For example, if the Keyframe Length is 60, then pixel 60 will display the data for pixel 1, pixel 59 will display the data for pixel 2, and so on to pixel 1 which will display the data for pixel 60. The pattern will then repeat again, with pixel 120 identical to pixel 60. This repetition continues for the maximum number of pixels supported by the hardware driver electronics.

Forward/Reverse Keyframe Copy 565 combines the first two algorithms described above, creating a mirrored pixel pattern that is twice the length of the keyframe. The first keyframe length of pixels displays as a Forward Keyframe, the next keyframe length displays as a Reverse Keyframe, and this symmetrical pattern then repeats for the maximum number of pixels supported by the hardware driver electronics.

Reverse/Forward Keyframe Copy 566 combines the first two algorithms described above, creating a mirrored pixel pattern that is twice the length of the keyframe. The first keyframe length of pixels displays as a Reverse Keyframe, the next keyframe length displays as a Forward Keyframe, and this symmetrical pattern then repeats for the maximum number of pixels supported by the hardware driver electronics.

Mapped Keyframe 568 allows the designer to create a look-up table mapping the relationship between control channels and physical pixels. The size of this map is limited only by the number of physical pixels supported by the hardware driver electronics. This provides the lighting designer with a powerful way to directly control how the keyframe data is applied to the pixels of a physical pixel string. In some embodiments, each driver may contain multiple maps selectable by the user, and real-time map selection may be done with a DMX control channel.

Embodiments of the invention include Custom Pixel Profiles, which are a collection of values for these parameters. The Custom Pixel Profiles are used by the custom pixel processing device (also known as control parameter processing unit) 380 utilizing the methods of the invention. In a preferred embodiment, this processing device 380 is part of the hardware pixel driver 120.

Additionally, for additional versatility, it is possible to manipulate one or more of these parameters in real time using DMX data from the DMX controller. For example, a DMX control channel could be used to set the Pixel Group Size to expand and contract the displayed pixel pattern in real time. Various embodiments of this method may limit or omit real time profile parameter control, or may provide real time control for only a subset of available parameters. In such cases, Custom Pixel Profile values are uploaded and stored in the pixel processor device 120, for example, in memory 360 (also known as control parameter storage unit).

In some embodiments, the Pixel Channel Footprint may be preset and hidden from the user. For example, it may be fixed at 3 for use primarily with red/green/blue pixels.

In some embodiments, the present invention provides a means of simultaneously controlling multiple hardware pixel drivers, each with a different Custom Pixel Profile configuration, to generate a large display with more visual complexity than is achievable with only 1-to-1 mapping. The following provide examples of Custom Pixel Profile implementation for creating pixel patterns:

1) Multiple pixel strings in parallel can be controlled with the same keyframe data but different Pixel Offset values to create a rippling, flowing, or triangulating effect across the strings.

2) Different Pixel Group Size values allow one keyframe to be displayed with different overall display widths or with different densities of pixel string. (Pixel density is typically described in pixels-per-inch.)

3) Additional variations in pattern and display can be achieved by varying Keyframe Length, DMX Start, DMX Offset, and other parameters to point the Custom Pixel Profile replication process to subsections of a keyframe. For example, some drivers might utilize an entire keyframe, while others might use a subset of channels located anywhere within (or even outside) that same keyframe. Many different and varied looks can be generated, all with inherent visual continuity, using a limited number of DMX control channels.

4) Pattern Replication Algorithms further expand the range of variation that can be achieved using the same keyframe data.

Additionally, different Custom Pixel Profiles can also utilize different keyframes located within the same DMX universe, making it possible to control multiple large banks of LEDs and deliver individual and independent visual effects that are all defined and controlled within a single DMX universe of only 512 data channels.

Thus, embodiments of the present invention provide an intuitive way to drive pixel strings with more physical pixels than a DMX controller is directly addressing. The Custom Pixel Profile method of pattern control leaves creative artistry in the hands of the DMX console programmer, while transferring the bulk of pattern repetition and replication functions from the DMX console to the Custom Pixel Profile processor 380. The Custom Pixel Profile processor 380 may be integrated with the hardware pixel driver 120 (the preferred embodiment) or in a preprocessor after the DMX controller and before one or more hardware pixel drivers.

The parametric approach of the invention provides the lighting designer with a familiar user interface resembling other programming tasks in lighting control programming. It requires a minimum of data entry and configuration, while providing a wide and powerful range of features and capabilities. When controlling Custom Pixel Profile values with DMX control channels, the lighting designer faces almost no new learning curve at all.

When a pattern is defined and represented using, for example, 60 DMX channels, only 60 channels need be generated by the DMX console, representing 20 red/green/blue pixels. This control method will replicate the data over a much larger field of pixels, rendering identical or nearly identical visual content to what would be generated by a large and powerful DMX controller, without requiring large and costly DMX consoles at the top of their class, and without "wasting" DMX channels merely to address a larger matrix of LED pixels with the same or predictably similar data to that used elsewhere.

For designers needing the full extent of 1-to-1 channel mapping, either continuously or at programmed times, a Keyframe Length of 170 and a Pixel Group Size of 1 provides this. Even then, Custom Pixel Profiles provides the advantage that pixels beyond the $170^{th}$ will continue the pattern, repeated in a method defined by the Pattern Replication Algorithm, out to the maximum number of pixels supported by the hardware driver electronics.

Alternatively or in addition, embodiments of the invention may provide a OneTouch method for assigning values to Pixel Profile parameters. In this embodiment, a series of DMX channels is set to levels that correspond with parameter settings through touch of a single button. The values are then saved, and then those DMX channels can be used for something else (like being part of the keyframe for pixel control). This embodiment provides a simplified alternative to having real-time DMX control of pixel parameters, and such approach that demands less processor power and can be realized at lower cost and with lower power draw. In embodiments, the OneTouch method may recognize tap, long press, and buttons in combination (hold one, tap the other).

In embodiments of the invention, the One Touch method for setting the Custom Pixel Profiles is provided as follows. First, a starting DMX channel is assigned by raising one DMX channel and then tapping the OneTouch set button. The raised channel becomes the assigned DMX channel. The levels of the subsequent channels—the ones immediately above the first raised channel—will configure Custom Pixel Profile settings. For example, the first channel up sets DMX channel, the level of the next channel sets keyframe length, the next sets group size, and so on. If those subsequent channels are all at zero, no changes occur to those pixel profile parameters. This makes it easy to change just the DMX channel or string type without modifying other settings.

Embodiments of the invention also provide a very small wireless DMX-controlled driver device for two separate strings of pixel LEDs, each string up to 500 pixels long, which is configured to implement Custom Pixel Profiles. In embodiments, the device of the invention provides RC4 ColorMatch for white-balance adjustment, and Custom Pixel Profiles to create beautiful pixel effects utilizing up to 3000 output channels (RGB×1000 pixels) while conserving the number of DMX control channels needed. In some embodiments, device parameters are accessible with a simple 3-button user interface. The DMX starting address can be set, as well as string type, pixel color order, and white-balance for each string without the need for a computer or RDM controller. Additionally, embodiments of the invention provide for software in the form of computer-readable code capable of displaying all parameters for both drivers together on one screen. The computer-readable code is capable of being executed by a processor and stored in a memory. In embodiments, additional features including parameters for grouping pixels to channels, setting how many channels will be used to control an entire string, and more. In embodiments, the drive device also provides a standard DMX data port, and an I2C interface for use with Arduino, Raspberry Pi, and other microcontrollers. Additionally, due to the small size of the device, an adaptor cable brings DMX data out to a standard XLR connector.

The device is simple and easy to understand, and overcomes all possible reasons for the color palette to appear poor in quality in a quickly built fixture: current limiters for each primary light source may be unbalanced; lumen output of the light sources may be unmatched; diffusers and filters may influence each primary differently; the light sources may not be accurately mounted and aimed, etc.

The device, in embodiments, achieves this with a single button push, delivering capture of ColorMatch ratios instantly. The device may take the form of a tiny battery-powered wireless-controlled box. Further, embodiments of the device may apply ColorMatch in all modes, not just HSL mode.

In embodiments of the device, the user adjusts the primary colors with a standard DMX lighting controller, a device they use every day and are very familiar with. They adjust color by eye to find the hue of white they like. The adjustment is visual with a smooth continuous range, not using digital sensors or presets. When the color is what the user wants (or what the director or director of photography wants), they press one button to capture the ratios/relationships between the primary colors that are live at that moment. Those ratios are then applied across the entire color spectrum, the whole gamut around the color wheel, any combination of primaries.

The small, battery-powered, radio controlled device embodiment receives DMX channel data from a wireless DMX transmitter and converts that data into one or more data streams suitable for controlling various brands, types, and forms of pixel lighting product. It is easily concealed, making it ideal for costumes, hats, props or set pieces in theatre, film, television, and other entertainment applications.

Using Custom Pixel Profiles, various effects and "looks" that previously demanded large, bulky, wired equipment can now be created in portable and untethered props, costumes, and set pieces. Multiple devices can simultaneously produce different patterns and effects by using different keyframes located within the same DMX universe.

In embodiments, the device provides 2 pixel string data outputs, separately configurable and capable of controlling 500 pixels each. The total of 1000 pixels of control is equivalent to 3000 DMX channels, which is more than 5 universes of traditional 1-to-1 channel mapped pixel control. Other embodiments may provide additional driver outputs and support more than 500 pixel channels per driver output, including 600, 700, 800, 900, 1000, 2000, 3000, 4000, 5000 or more pixels per driver output.

Thus, rather than simple 1:1 mapping of DMX channels to pixels, which is limited to just 170 pixels with a single DMX universe, the Custom Pixel Profiles allow a user to group contiguous pixels to respond together, and assign a sequence of channels to be assigned repeatedly along the length of a string. Then, using console programming of just a few DMX channels, embodiments of the invention allow visual effects to be mapped over two strings of 500 pixels—a total of up to 1000 pixels and the equivalent of 3000 control channels.

In embodiments, the device provides for the Custom Pixel Profile control method described herein. The device allows a small driver receiving a single DMX universe of data to produce a wide range of complex patterns over a large field of LEDs.

Alternatively or in addition, the device may include a bootloader so that users in the field can update and upgrade device firmware. Such ability to provide for upgrades allows a user to add new types and architectures of pixel string, add new Pattern Replication Algorithms, and more.

In embodiments, the device also includes user-configurable pixel color order. This is useful when DMX console control is based on red-green-blue color order, but physical pixel components address colors in a different order. By compensating for this in the device, there is no need to duplicate channels in the DMX controller just to reorder colors for different pixel strings otherwise displaying the same content. Other pixel drivers already exist that provide this feature.

In embodiments, the device also includes user-configurable color correction. This allows different pixel strings with visibly different color rendering to be matched using ratiometric level compensations in the driver. Color correction in the driver eliminates the need for duplicate channels in the DMX controller just to correct color for different pixel strings otherwise displaying the same content.

EXAMPLES

The two example pixel pattern applications described in the Background are easily accomplished with far fewer DMX channels using the Custom Pixel Profiles of the present invention.

Example 1: Simple Marquee

The described marquee effect can be flawlessly and identically recreated using a Custom Pixel Profile with a Keyframe Length of 3 pixels, which is just 9 DMX control channels. This short keyframe can be located anywhere within a universe of 512 channels. No channel offset is required for this effect. The Forward Keyframe Copy algorithm takes care of the rest.

There is no longer a limit of 80 lamps in the marquee. With no changes to the Custom Pixel Profile or the data generated by the DMX console, the number of lamps is limited only by the addressing limits of the hardware pixel driver. This makes it much easier to change the size of the set, the pixel density of the string, and more, with little or no impact on the Custom Pixel Profile setup, and no impact at all on DMX effect programming in the DMX console.

Example 2: Symmetrical Patterns Around a Procenium

A great looking effect with lots of creative flexibility is easily achieved using one DMX universe—170 pixels—as the keyframe. This is less than ⅙th of the channels needed to control 1000 pixels using traditional 1-to-1 channel mapping.

The lighting designer may choose to use a Group Size of 3 to display the keyframe over one side of the proscenium without pattern replication, or use any of the available Replication Algorithms to bounce and reflect the programmed pattern past the 170th pixel.

Identical configuration of a Custom Pixel Profile driver for pixels on the second half (the other side) of the proscenium will mirror the appearance of the first half, consuming no additional control channels and delivering an attractive symmetrical look.

There is no longer a limit of 500 pixels per side. Additional Custom Pixel Profile processors and hardware drivers can be added to utilize the same keyframe data with more pixel strings to increase the visual density, light output, and more, with little or no changes to DMX programming or DMX channels used.

The present invention has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention. Further, a skilled artisan will further appreciate, in light of this disclosure, how the invention can be implemented, using hardware, firmware, software, or a combination thereof. As such, as used herein, the operations of the invention can be implemented in a system comprising any combination of software, hardware, or firmware.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A method for controlling and generating graphical patterns among pixel LEDs, comprising:

generating keyframe data, which is a source pattern authored by a lighting designer in real-time by manipulating a first set of DMX control channels of a DMX controller;

providing control parameters comprising each of the following:

one or more settings which define one or more characteristics of the keyframe data including a length of the source pattern in terms of a number of pixels, wherein the number of pixels may be set as a subset of pixels of a pixel LED string; and one or more pattern replication algorithms configured to display the keyframe data in replicable patterns by mapping and repeating the source pattern across one or more blocks of pixel LEDs, wherein each block has a number of pixels equal to the length of the source pattern;

assigning a specific DMX control channel chosen from a second set of DMX control channels of the DMX controller for each of the control parameters;

adjusting the control parameters by setting one or more of the assigned DMX channels to levels that correspond with the one or more settings of the control parameters; and processing DMX channel data comprising the keyframe data from a DMX controller based on the control parameters;

wherein the processing occurs at a point of processing external to the DMX controller;

wherein the control parameters define how the keyframe data is interpreted, processed, and distributed among the pixel LEDs to generate graphical patterns;

wherein each pixel LED comprises a plurality of colors selected from the group consisting of red, green, blue, amber and white;

wherein the one or more assigned DMX channels provide a capability for the lighting designer to create graphical patterns among the pixel LEDs by manipulating the replication, repetition and distribution of the source pattern among the pixel LEDs in real time such that groups of contiguous pixels respond together and such that a ratio of pixel LED colors addressed per DMX channel exceeds 1 to 1;

wherein neither the source pattern nor the graphical patterns among the pixel LEDs are preprogrammed patterns.

2. The method of claim 1, wherein the point of processing is at one or more individual hardware drivers for the pixel LEDs.

3. The method of claim 1, wherein the point of processing is at a pre-processor between the DMX controller and one or more individual hardware drivers for the pixel LEDs.

4. The method of claim 2, wherein the control parameters are uploaded and stored in a memory of the one or more individual hardware drivers for the pixel LEDs.

5. The method of claim 3, wherein the control parameters are uploaded and stored in a memory of the pre-processor between the DMX controller and one or more individual hardware drivers for the pixel LEDs.

6. The method of claim 1, further comprising the step of saving values of the settings by pressing a single button after adjustment of the settings of the control parameters.

7. The method of claim 1, wherein the one or more settings comprise one or more of:

a Pixel Channel Footprint, which is a number of individual DMX control channels that control a single LED pixel;

DMX Start, which is a channel number within a 512-channel DMX universe where keyframe data begins;

DMX Offset, which denotes a channel within a keyframe where a pixel driver will begin pattern generation for its first physical pixel; and Pixel Group Size, which allows multiple physical pixels to be mapped to each control pixel.

8. The method of claim 1, wherein the one or more pattern replication algorithms comprise one or more of:

Forward Keyframe Copy, which displays keyframe data as presented by the DMX controller, and then repeats the keyframe for subsequent blocks of pixels;

Reverse Keyframe Copy, which displays keyframe data as presented by the external DMX controller, but mapped to pixels in reverse order;

Forward/Reverse Keyframe Copy, which combines Forward Keyframe Copy and Reverse Keyframe Copy to create a mirrored pixel pattern that is twice the length of the keyframe, wherein a first keyframe length of pixels displays as a Forward Keyframe, and a second keyframe length of pixels displays as a Reverse Keyframe;

Reverse/Forward Keyframe Copy, which combines Forward Keyframe Copy and Reverse Keyframe Copy to create a mirrored pixel pattern that is twice the length of the keyframe, wherein a first keyframe length of pixels displays as a Reverse Keyframe and a second keyframe length of pixels displays as a Forward Keyframe; and Mapped Keyframe, which provides a look-up table mapping a relationship between control channels and physical pixels.

9. A device for controlling and generating graphical patterns among pixel LEDs comprising:

a storage unit comprising control parameters which are configured to control keyframe data, which keyframe data is a source pattern authored by a lighting designer in real-time by manipulating a first set of DMX control channels of a DMX controller, which control parameters comprise each of the following:

one or more settings which define one or more characteristics of the keyframe data including a length of the source pattern in terms of a number of pixels, wherein the number of pixels may be set as a subset of pixels of a pixel LED string; and one or more pattern replication algorithms configured to display the keyframe data in replicable patterns by mapping and repeating the source pattern across one or more blocks of pixel LEDs, wherein each block has a number of pixels equal to the length of the source pattern;

a receiver capable of receiving DMX channel data comprising the keyframe data from a DMX controller; and a processing unit programmed to assign a specific DMX control channel chosen from a second set of DMX control channels of the DMX controller for each of the control parameters;

wherein the processor is capable of processing the keyframe data based on the control parameters;

wherein the control parameters define how the keyframe data is interpreted, processed, and distributed among the pixel LEDs to generate graphical patterns;

wherein the device is external to the DMX controller;

wherein each pixel LED comprises a plurality of colors selected from the group consisting of red, green, blue, amber and white;

wherein during use the one or more assigned DMX channels provide a capability for the lighting designer to create graphical patterns among the pixel LEDs by manipulating the replication, repetition and distribution of the source pattern among the pixel LEDs in real time such that groups of contiguous pixels respond together and such that a ratio of pixel LED colors addressed per DMX channel exceeds 1 to 1;

wherein neither the source pattern nor the graphical patterns among the pixel LEDs are preprogrammed patterns.

10. The device of claim 9, wherein the device is capable of receiving DMX channel data from a wireless DMX transmitter at the receiver and converting the DMX channel data to one or more outputs, wherein each output is capable of controlling a pixel LED string comprising at least 500 red/green/blue pixel LEDs.

11. The device of claim 9, which is battery powered.

12. The device of claim 9, further comprising a memory capable of storing settings of the control parameters.

13. The device of claim 9, comprising a bootloader which provides a capability of updating the control parameters.

14. The device of claim 9, wherein the device is configured to provide a capability to configure pixel color order.

15. The device of claim 9, wherein the device is configured to provide a capability to correct color discrepancies among pixel LED strings.

16. The device of claim 9, wherein the device is configured to provide a capability of saving values of the control parameters by pressing a single button.

17. The device of claim 9, wherein the one or more settings comprise one or more of:

a Pixel Channel Footprint, which is a number of individual DMX control channels that control a single LED pixel;

DMX Start, which is a channel number within a 512-channel DMX universe where keyframe data begins;

DMX Offset, which denotes a channel within a keyframe where a pixel driver will begin pattern generation for its first physical pixel; and Pixel Group Size, which allows multiple physical pixels to be mapped to each control pixel.

18. The device of claim 9, wherein the one or more pattern replication algorithms comprise one or more of:

Forward Keyframe Copy, which displays keyframe data as presented by the DMX controller, and then repeats the keyframe for subsequent blocks of pixels;

Reverse Keyframe Copy, which displays keyframe data as presented by the external DMX controller, but mapped to pixels in reverse order;

Forward/Reverse Keyframe Copy, which combines Forward Keyframe Copy and Reverse Keyframe Copy to create a mirrored pixel pattern that is twice the length of the keyframe, wherein a first keyframe length of pixels displays as a Forward Keyframe, and a second keyframe length of pixels displays as a Reverse Keyframe;

Reverse/Forward Keyframe Copy, which combines Forward Keyframe Copy and Reverse Keyframe Copy to create a mirrored pixel pattern that is twice the length of the keyframe, wherein a first keyframe length of pixels displays as a Reverse Keyframe and a second keyframe length of pixels displays as a Forward Keyframe; and Mapped Keyframe, which provides a look-up table mapping a relationship between control channels and physical pixels.

* * * * *